US006978535B2

(12) United States Patent
Tien

(10) Patent No.: US 6,978,535 B2
(45) Date of Patent: Dec. 27, 2005

(54) PRESSING DEVICE FOR THIN-FILM CIRCUIT AND TERMINAL

(76) Inventor: David Tien, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/435,543

(22) Filed: May 12, 2003

(65) Prior Publication Data

US 2004/0226168 A1 Nov. 18, 2004

(51) Int. Cl.[7] ..... H01R 43/00

(52) U.S. Cl. ..... 29/748; 29/747; 29/751; 29/33 M; 72/421

(58) Field of Search ..... 29/748, 751, 753, 29/755, 861, 863, 33 M, 884, 754, 564.4, 29/566.2; 72/470, 441, 448, 446, 420, 712

(56) References Cited

U.S. PATENT DOCUMENTS 5,575,061 A * 11/1996 Tsuji et al. ..... 29/748
5,752,405 A * 5/1998 Gerst et al. ..... 72/312
6,026,562 A * 2/2000 McMillin et al. ..... 29/748
6,327,775 B1 * 12/2001 Oishi et al. ..... 29/751
6,530,257 B2 * 3/2003 Ooji et al. ..... 72/420

OTHER PUBLICATIONS

DE 20307271U1 publication Jul. 24, 2003, press system for connector (abstract only).*

* cited by examiner

*Primary Examiner*—Minh Trinh

(57) ABSTRACT

A pressing device for thin-film circuits and terminals includes the characteristics of a machine base provided with a bottom panel, and a cutting block and a pressing block capable of intermittent up-and-down displacement at an interior thereof; an inner modular base capable of elastic displacement and flexibly disposed in a projecting column on the bottom panel; and an outer modular base fixed at an outer side of the inner modular base. Wherein, the outer modular base presses onto an upper pressing plane using downward displacement of the pressing block, and a cutting-edge portion slides upward along a rear sliding wall of the inner modular base, thereby accurately puncturing, stamping and connecting a plurality of terminals onto silvered wires of a thin-film circuit at a time.

4 Claims, 11 Drawing Sheets

PRESSING DEVICE FOR THIN-FILM CIRCUIT AND TERMINAL

BACKGROUND OF THE INVENTION (a) Field of the Invention

The invention relates to a pressing device for thin-film circuits and terminals, and more particularly, to a pressing device capable of effectively puncturing and pressing metal terminals onto silvered wires of flexible circuits.

(b) Description of the Prior Art

According to conventional terminal pressing devices, metal terminals are encapsulated and stamped onto electroformed wires or copper wires, thereby connecting the terminals to the wires.

In addition, a flexible plastic thin-film printed having silvered wires as circuits at an interior thereof is available on the market, and is being extensively applied in electronic products.

However, difficulties indeed exist in stamping metal terminals onto the thin-films circuits at the present time. The process of stamping a terminal onto a single silvered wire of a thin-film circuit is rather inefficient, and accuracy of conductivity obtained by stamping a plurality of terminals onto a plurality of silvered wires of a thin-film circuit is also rather low due to poor positioning. Hence, it is a vital task of the invention as how to position, stamp and connect a plurality of terminals to a plurality of silvered wires of a flexible circuit at a time.

SUMMARY OF THE INVENTION

Therefore, the primary object of the invention is to provide a pressing device for thin-film circuits and terminals capable of accurately puncturing, stamping and connecting a plurality of terminals onto silvered wires on a thin-film circuit at a time.

DETAILED DESCRIPTION OF THE PREFERRED EMBODIMENTS

To better understand the characteristics and functions of the invention, detailed descriptions shall be given with the accompanying drawings hereunder.

Figure 1:
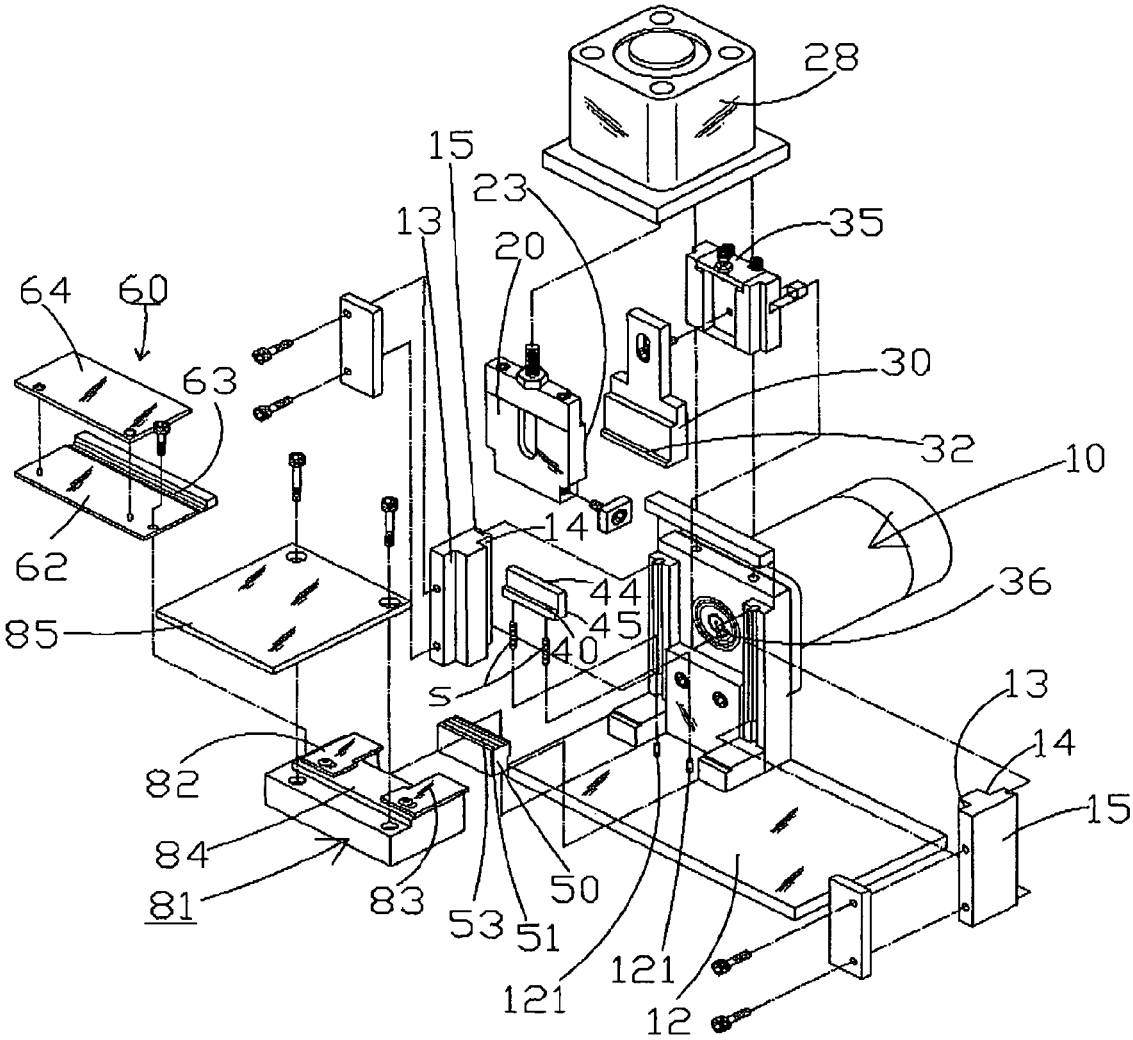
FIG. 1 shows an exploded elevational view illustrating an embodiment according to the invention.
Figure 2:
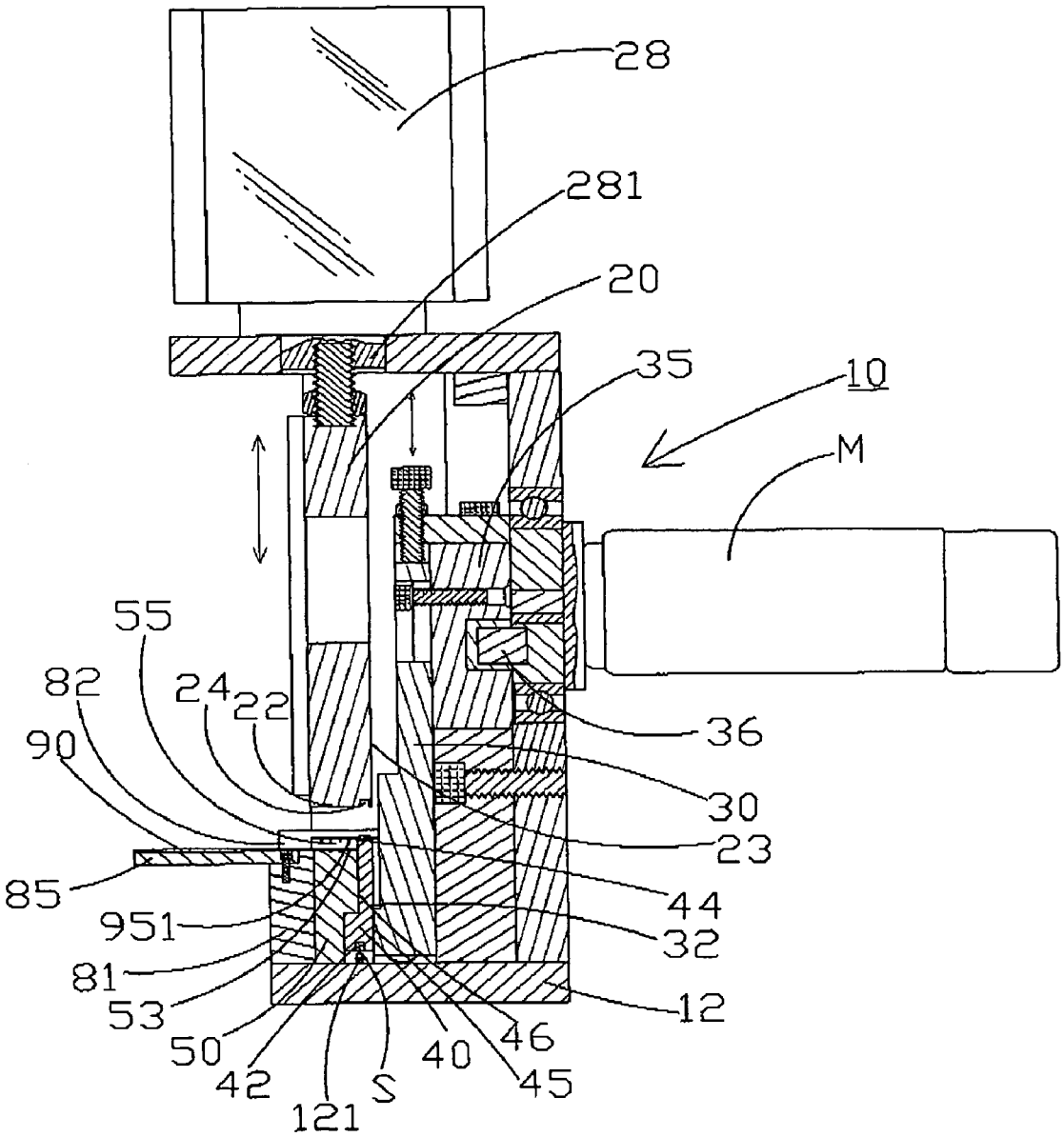
FIG. 2 shows a first sectional view illustrating movements according to the invention.
Figure 3:
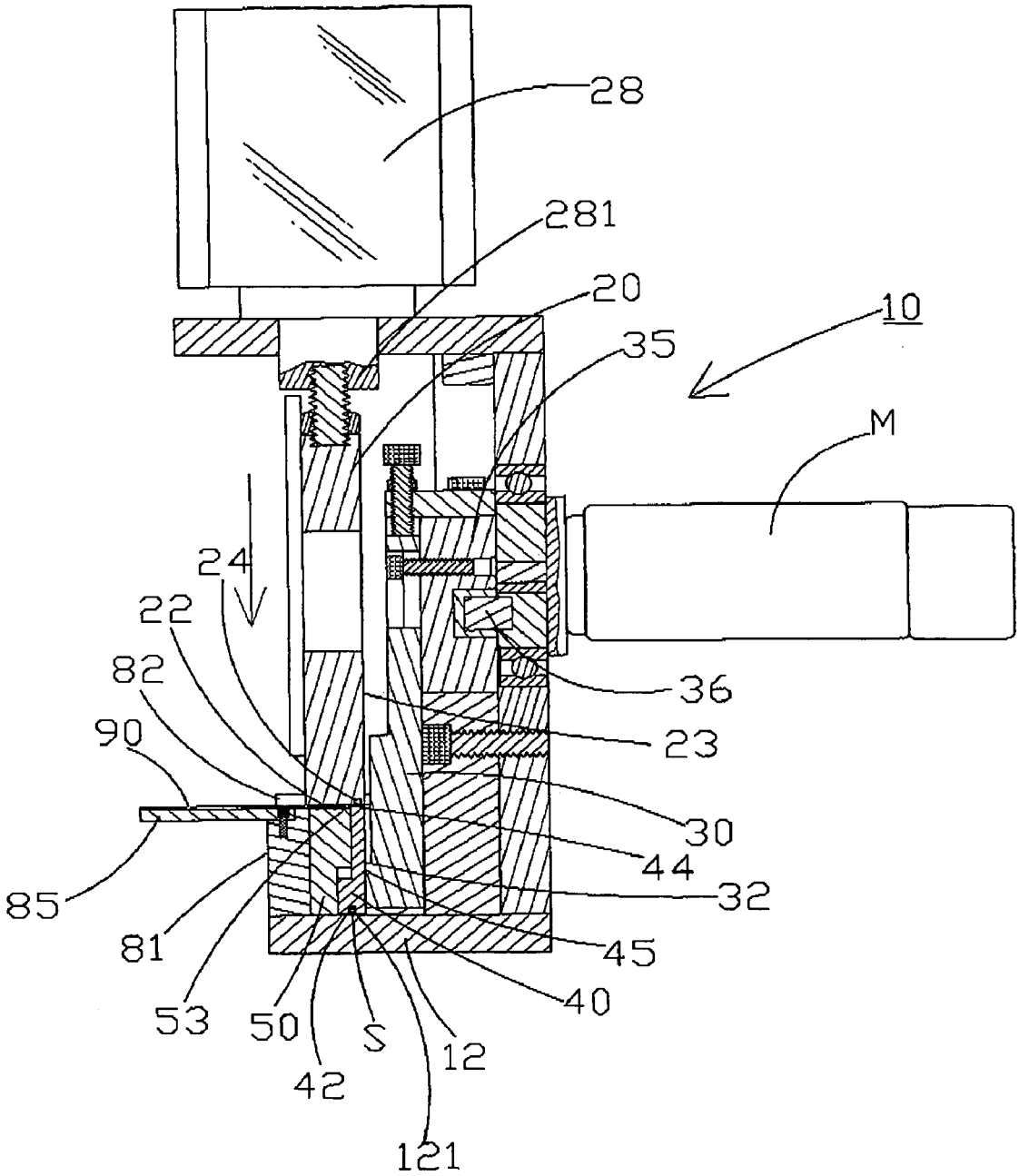
FIG. 3 shows a second sectional view illustrating movements according to the invention.

Referring to FIGS. 1, 2 and 3, the device according to the invention comprises:

a machine base 10 provided with a bottom panel 12;

two side boards 15 having inner and outer sliding tracks 14 and 13, respectively, and vertically disposed and fastened to the machine base 10; and a pressing block 20 capable of up-and-down displacement flexibly connected to the outer sliding tracks 13;

a cutting block 30 capable of up-and-down displacement and formed with a laterally molded cutting-edge portion 32;

at least one projecting column 121 disposed on the bottom panel 12 slightly below the pressing block 20, and a spring S accommodated around and connected to the projecting column 121;

an inner modular base 40 having a through orifice 42 at a bottom end thereof and a pressure receiving plane 44; wherein the spring S and the projecting column 121 are penetrated into the through orifice 42 for enabling the inner modular base 40 to function as an elastic element; and an outer modular base 50 fixed on the bottom panel 12, situated at a side of the inner modular base 40, and provided with a plurality of grooves 151 at an upper pressing plane 53 of the outer modular base 50;

wherein downward displacement of the pressing block 20 presses on the upper pressing plane 53, and the cutting-edge portion 32 slides upward along a rear sliding wall 45 at a rear end of the inner modular base 40 along with ascension of the cutting block 30.

Figure 11:
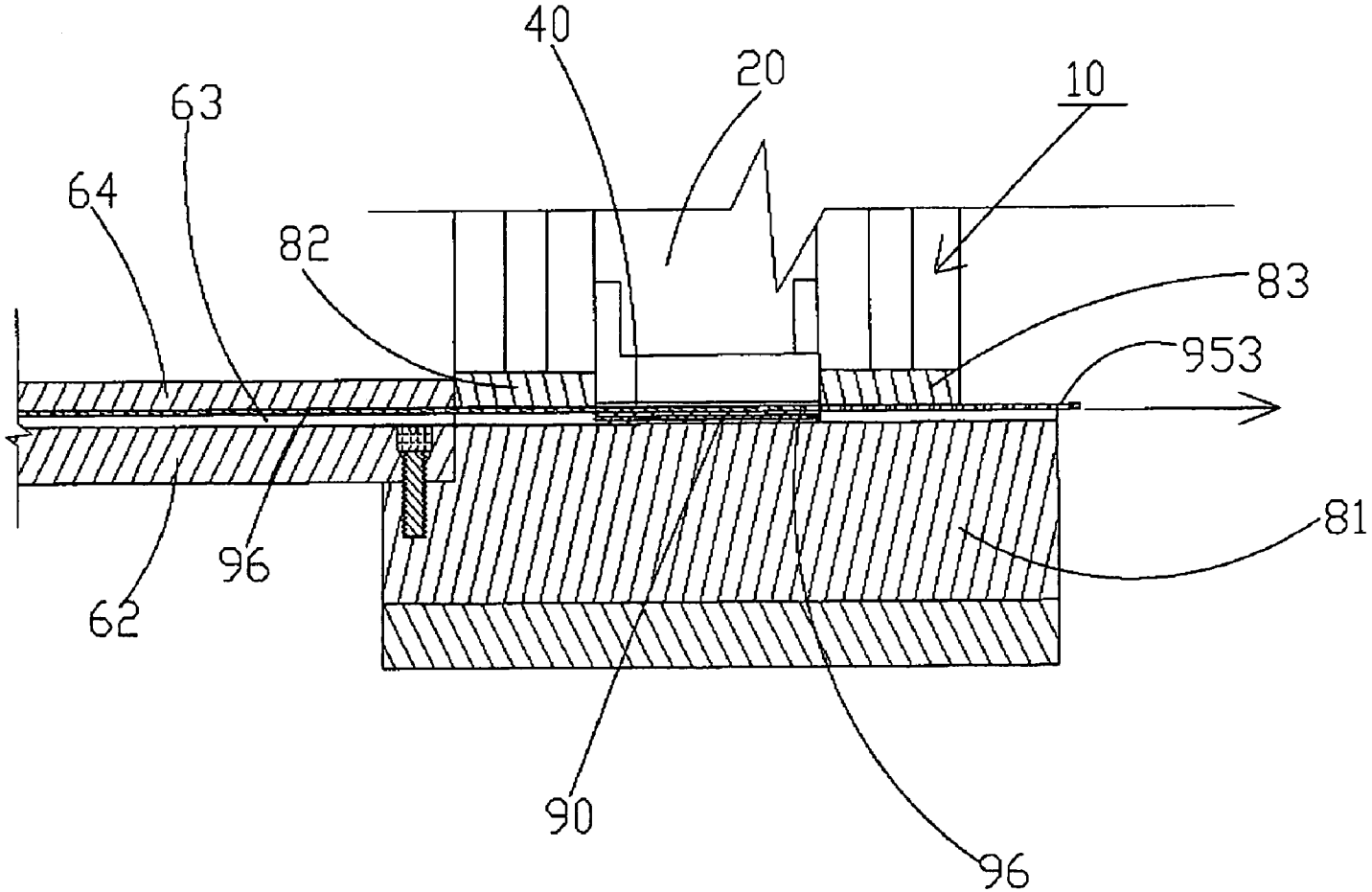
FIG. 11 shows a sectional view illustrating a terminal material belt according to the invention being transversely displaced.

According to the aforesaid primary characteristics, wherein a material delivery device 60 is disposed at a side of the outer modular base 50, and comprises:

a bottom panel 62 and an outer cover 64 forming a guiding channel 63 for a terminal material tape 96 to extend into as shown in FIG. 11.

According to the aforesaid primary characteristics and referring to FIGS. 1, 2 and 3, wherein a device for leading-in a thin-film circuit 90 is located at an outer side of the outer modular base 50, and comprises:

a base 81 fastened to the bottom panel 12;

a pair of side plates 82 and 83 fastened to surfaces at two sides of the base 81, and a guiding channel 84 formed between the side plates 82 and 83; and a flat plate 85 fastened to an outerside of the base 81, such that the circuit 90 is lead-in via the guiding channel 84 and extended to the upper pressing plane 53.

According to the aforesaid primary characteristics, wherein the pressing block 20 is connected with a piston shaft 281 of a pressure tank 28, thereby enabling the pressing block 20 to make intermittent up-and-down displacement; and the cutting block 30 is fastened to a sliding block 35 that receives forces from rotations of an eccentric axis 36, thereby enabling the cutting block 30 to make intermittent up-and-down displacement.

Figure 5:
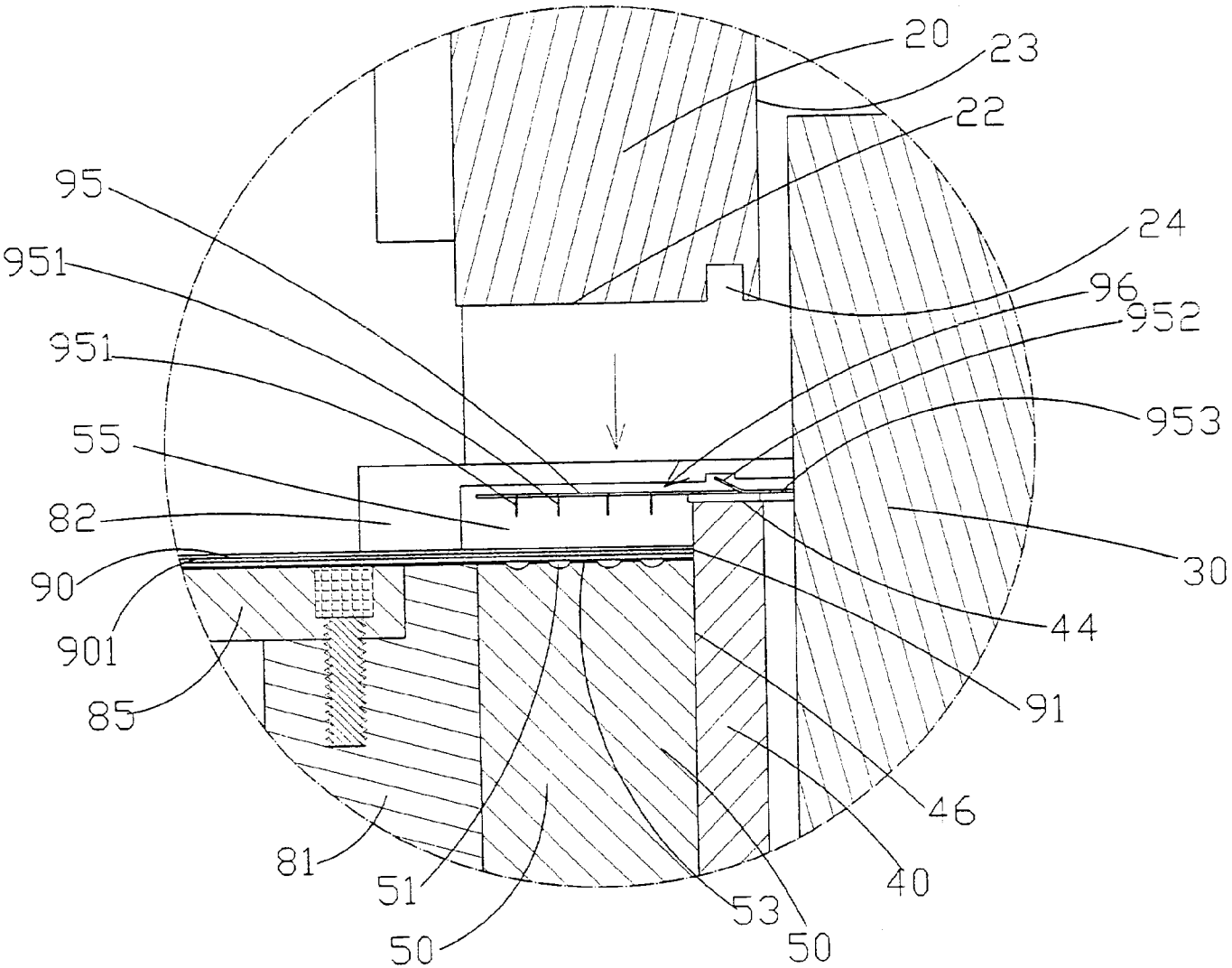
FIG. 5 shows an enlarged sectional view illustrating a terminal according to the invention before being stamped.
Figure 6:
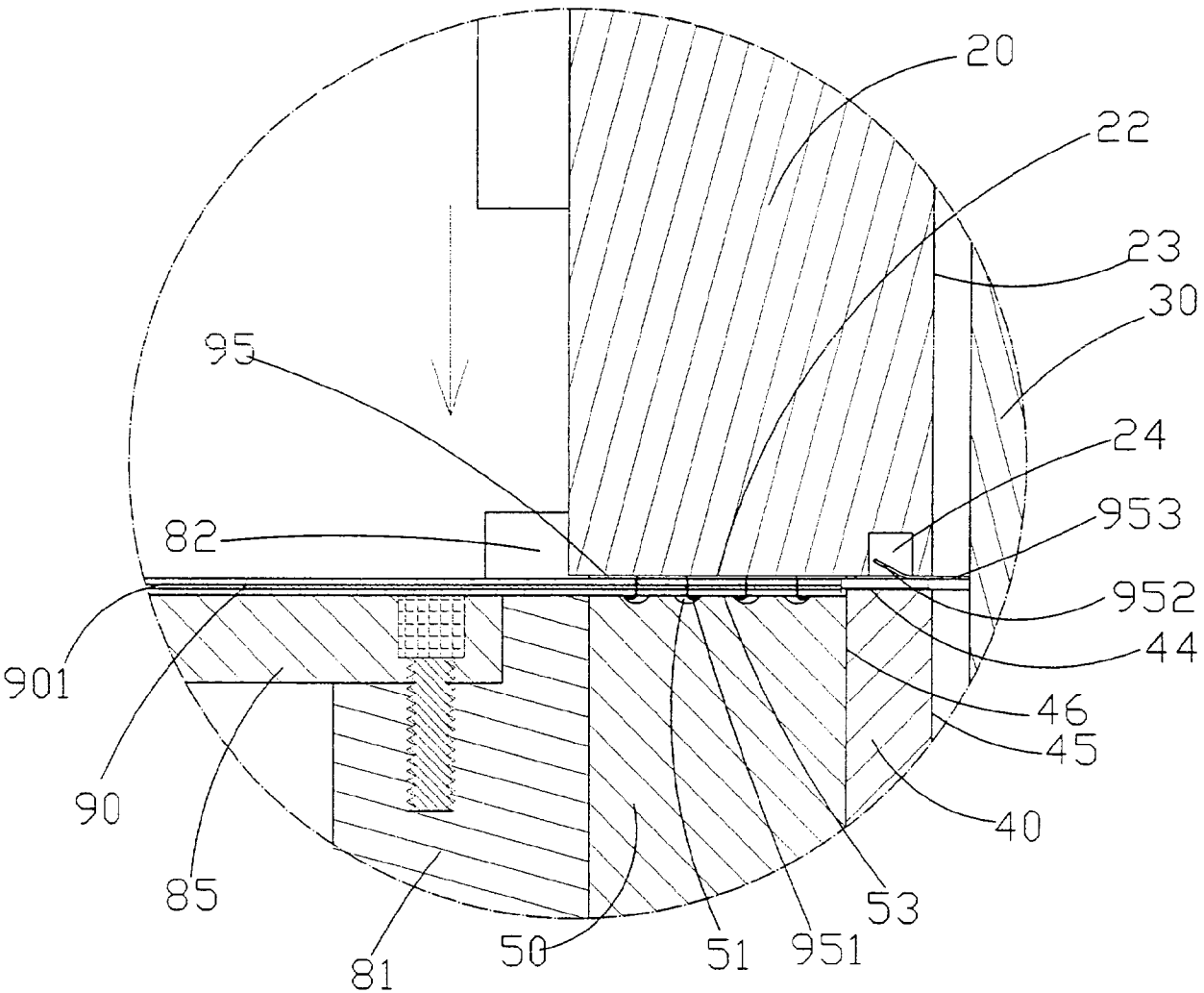
FIG. 6 shows an enlarged sectional view illustrating a terminal according to the invention having been stamped and connected onto a thin-film circuit.
Figure 9:
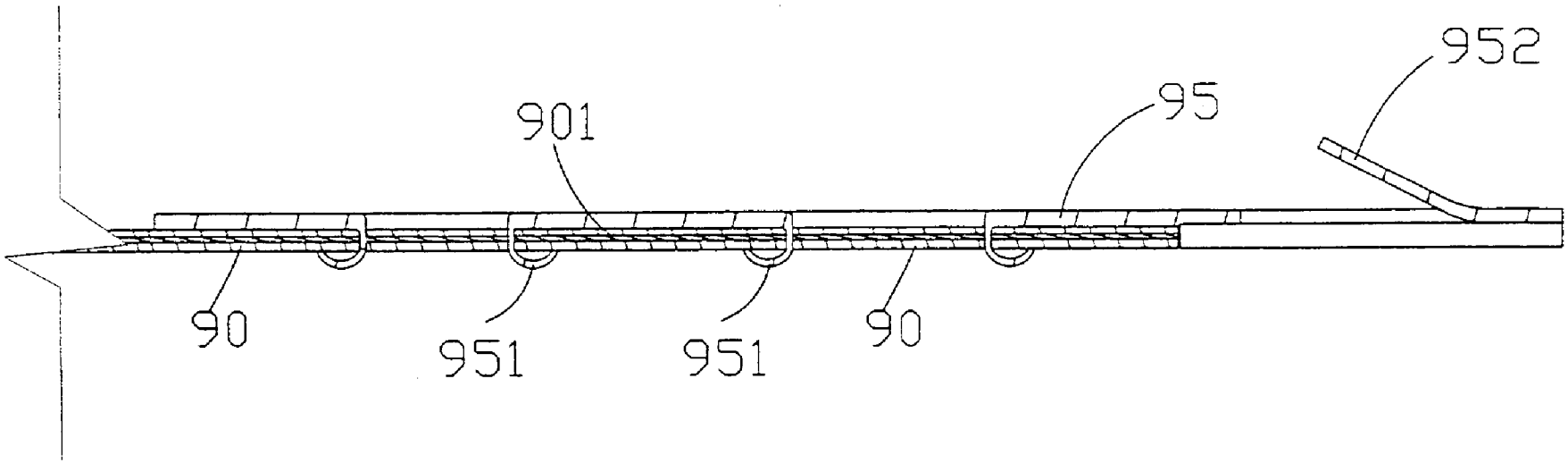
FIG. 9 shows a sectional view illustrating a terminal being positioned onto a circuit according to the invention in processing.
Figure 10:
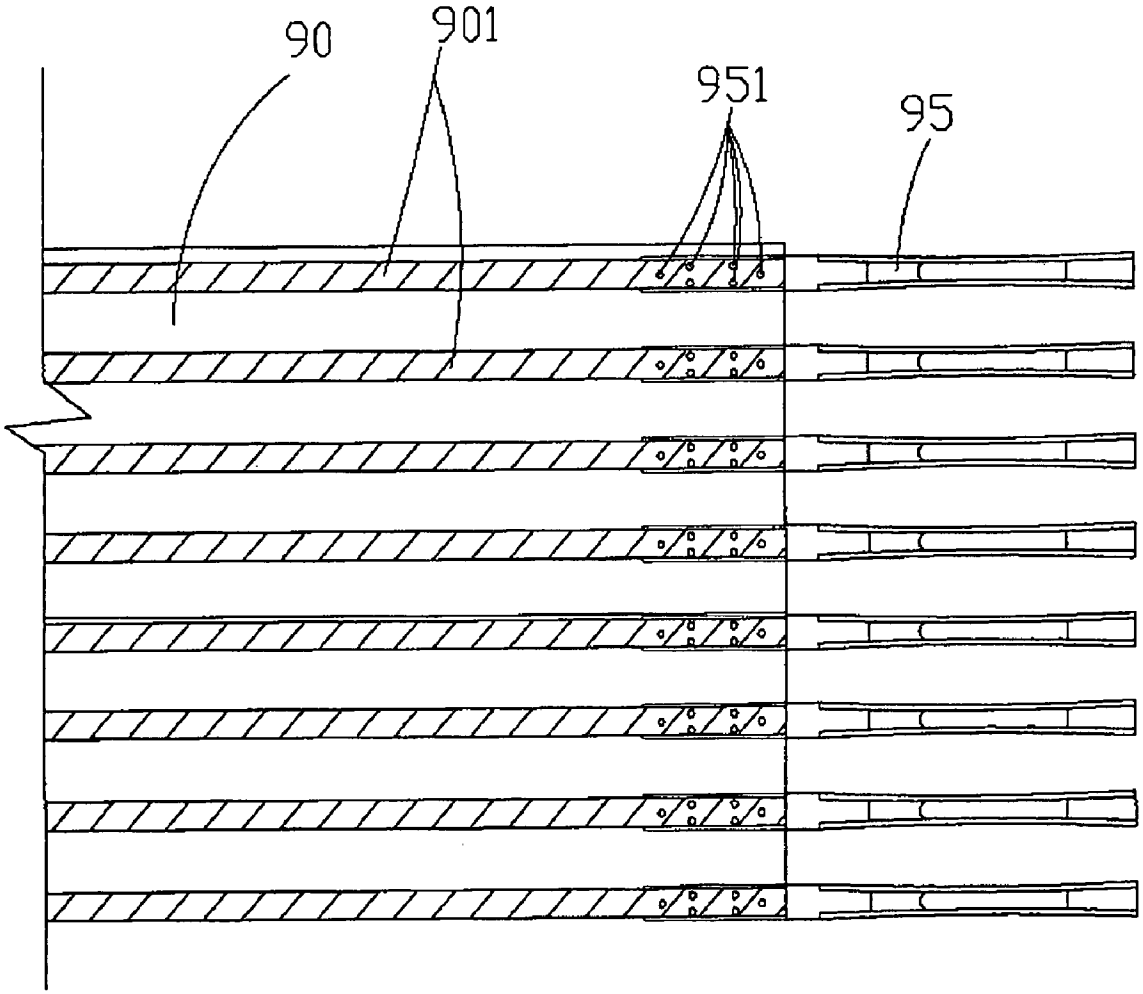
FIG. 10 shows a planar view illustrating a terminal being positioned onto a circuit according to the invention in processing.

According to the aforesaid primary and secondary characteristics, the embodiment according to the invention has the following excellences when put to use:

1. Illustrations of movements of the terminal 95 being stamped onto the circuit 90 shall be described. Referring to FIG. 5, the terminal 95 is provided with a plurality of outwardly projecting sharp portions 951 at a front end thereof, and a spring piece 952 that projects outwardly in a reverse direction at the other end thereof and is connected to a connection tape 953 for forming the terminal material tape 96. Referring to FIG. 11, the terminal material tape 96 is guided into the guiding channel 63 of the material delivery device 60, wherein the sharp portions 951 are faced downward, and the spring piece 952 is faced upward. An outermost end of the material tape 96 is withdrawn using a material withdrawing device (not shown in the diagram), so as to intermittently forward the terminal material tape 96 in the guiding channel 63 at a speed of a pitch at a time. Referring to FIGS. 1 and 5, the spring piece 952 is situated on a surface of the inner modular base 40, and the sharp portions 951 are situated and suspended above the upper pressing plane 53, such that a gap 55 exists between the sharp portions 951 and the upper pressing plane 53. A flexible thin-film circuit 90 is penetrated into the guiding channel 84 through the flat plate 85 and extended into the gap 55, and an end portion 91 of the circuit 90 is butted against a back-and-forth sliding wall 46 of the inner modular base 40. An inner side of a stamping plane 22 of the pressing block 20 is provided with a transverse groove 46. When the pressing block 20 is activated by the pressure tank 28 and displaces downward, the pressing plane 22 thereof is pressed onto the pressure receiving plane 44. Owing to the presence of the transverse groove 24, the spring piece 952 is placed into the transverse groove 24 and protected from damages. When the pressure receiving plane 44 is stamped, the inner modular base 40 descends, and the spring S shows a contracted state as shown in FIGS. 3 and 6. Next the terminal 95 is positioned by the pressing plane 22 and is also descended along with the inner modular base 40, and hence the sharp portions 951 are punctured through the circuit 90 to come into contact with a region of silvered wires 901 of the circuit 90 as shown in FIGS. 9 and 10. At the same time, the sharp portions 951 are collided into a plurality of channels 51, deformed and bent inward after puncturing the circuit 90 as shown in FIG. 6, and further stamped and positioned at an interior of the circuit 90 as shown in FIGS. 9 and 10.

Figure 4:
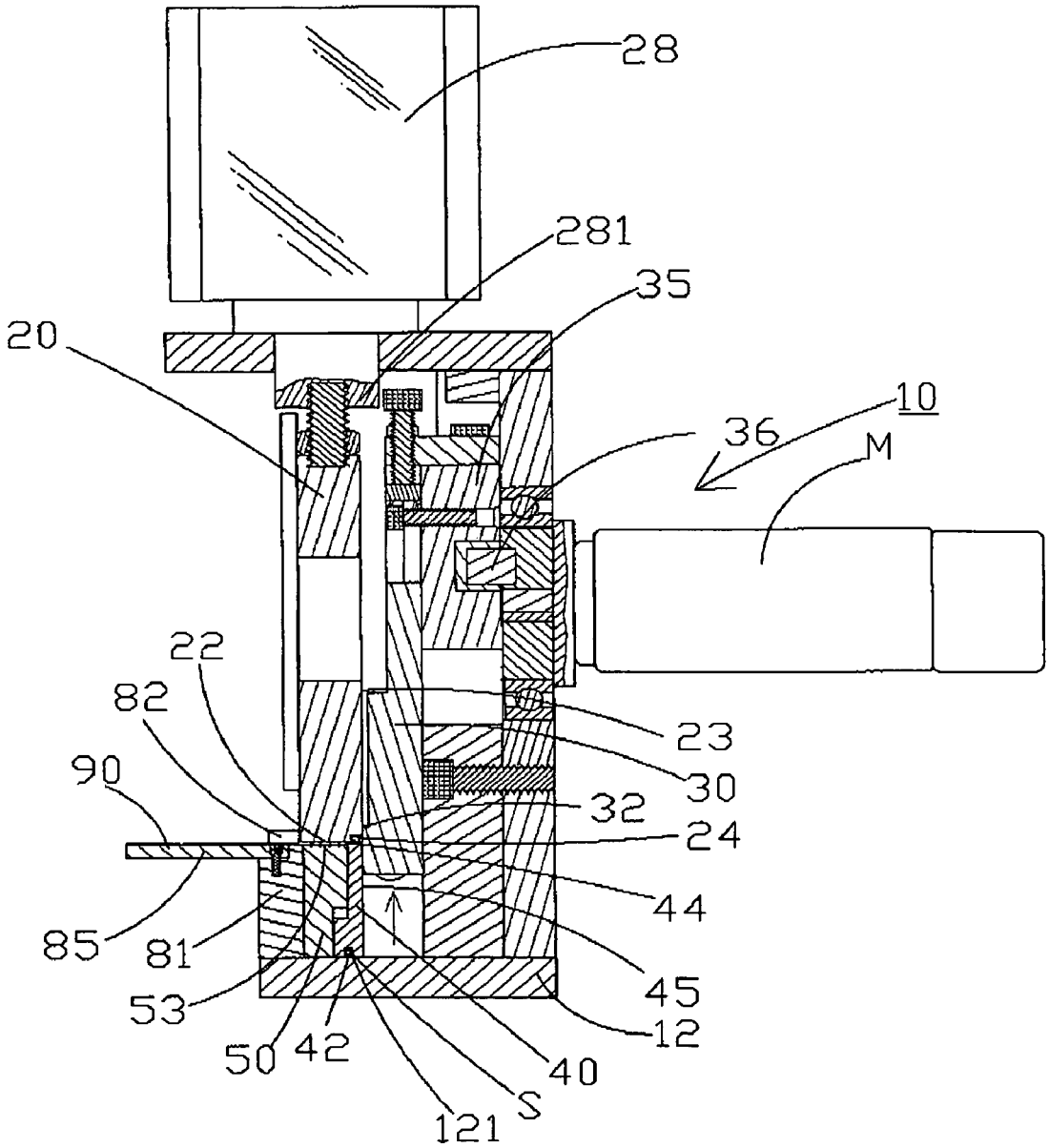
FIG. 4 shows a third sectional view illustrating movements according to the invention.
Figure 7:
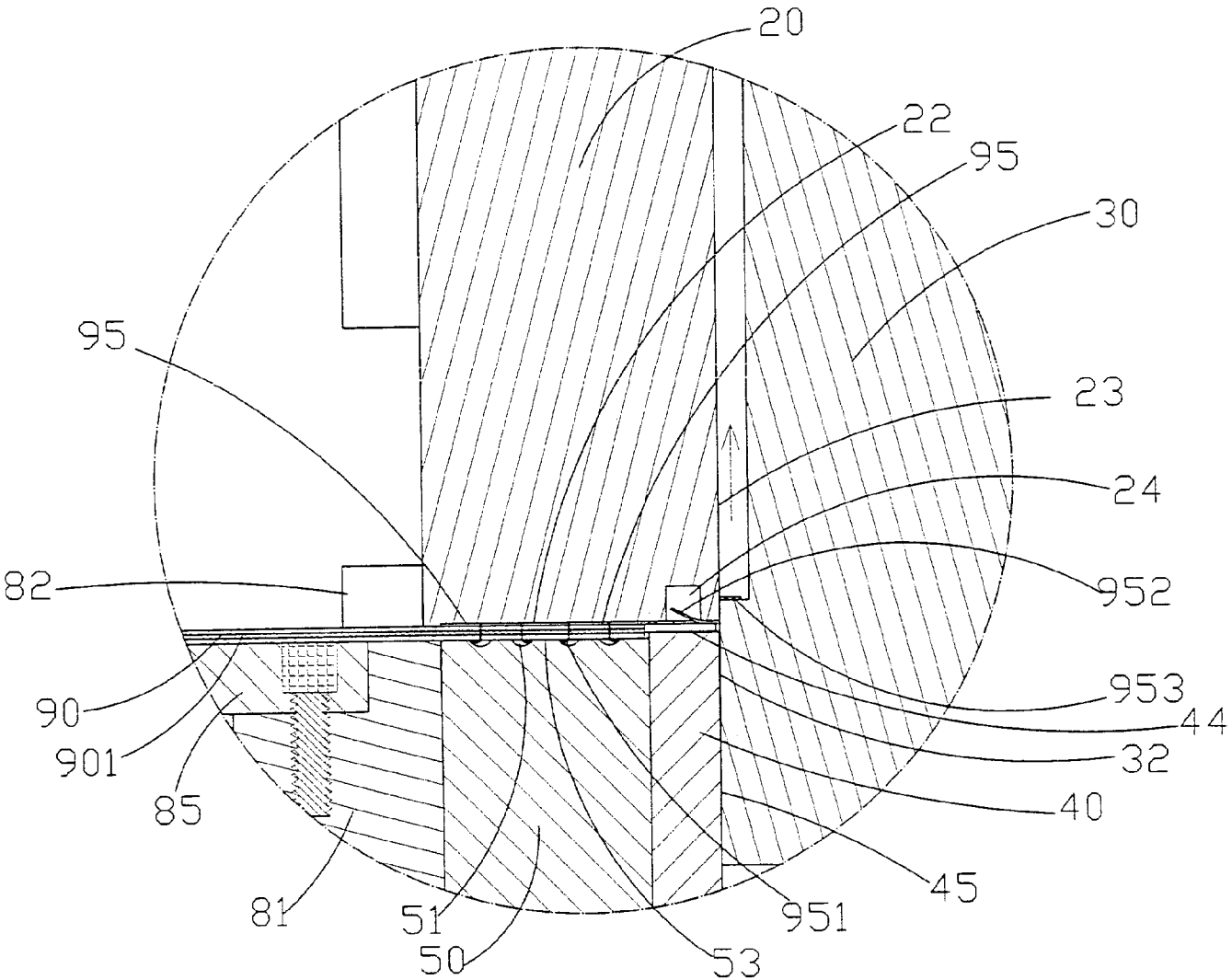
FIG. 7 shows an enlarged sectional view illustrating a terminal and a material tape according to the invention being cut off and separated.
Figure 8:
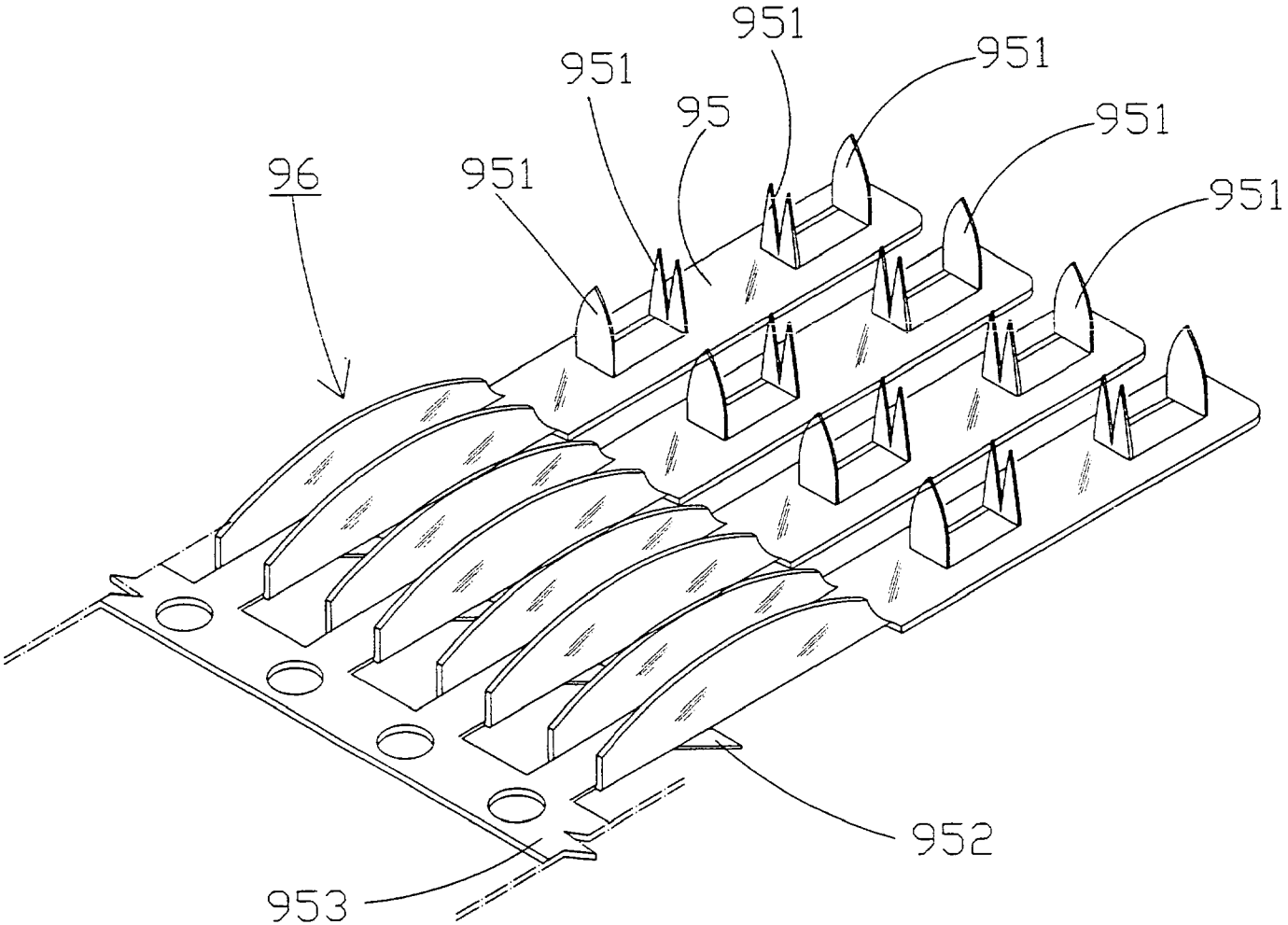
FIG. 8 shows an elevational view illustrating a terminal material tape according to the invention being processed.

2. Illustrations of cutting and separation of the terminal 95 and the connection tape 953 shall be described below. Using powering on of a motor M, the eccentric axis 36 is rotated for forcing the sliding block 35 to displace upward as shown in FIG. 4, and the cutting block 30 simultaneously displaces upward along with the sliding block 35 as shown in FIG. 7. Therefore, the cutting-edge portion 32 is slid upward along a rear sliding wall 45 toward a rear sliding wall 23 of the pressing block 20. During the process of sliding, the connection tape 953 and the terminal 95 are cut off and separated. Subsequently, the pressing block 20 is ascended for repositioning, and the cutting block 30 is descended for repositioning, forces acting upon the inner modular base 40 are dismissed, the spring S is repositioned, and the inner modular base 40 is ascended. As a result, a finished product of a circuit 90 having a punctured, stamped and positioned terminal 95 is obtained as shown in FIGS. 9 and 10.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A pressing device for thin-film circuits and terminals comprising:

a machine base provided with a bottom panel;

two side boards having inner and outer sliding tracks, respectively, and vertically disposed and fastened to the machine base; and a pressing block capable of up-and-down displacement and flexibly connected to the outer sliding tracks;

a cutting block capable of intermittent up-and-down displacement formed with a laterally molded cutting-edge portion;

at least one projecting column disposed on the bottom panel slightly below the pressing block, and a spring accommodated around and connected to the projecting column;

an inner modular base having a through orifice at a bottom end thereof and a pressure receiving plane; wherein the spring and the projecting column are penetrated into the through orifice for enabling the inner modular base to function as an elastic element; and an outer modular base fixed on the bottom panel, situated at a side of the inner modular base, and provided with a plurality of grooves at an upper pressing plane of the outer modular base; wherein downward displacement of the pressing block presses on the upper pressing plane, and the cutting-edge portion slides upward along a rear sliding wall at a rear end of the inner modular base along with ascension of the cutting block.

2. The pressing device for thin-film circuits and terminals in accordance with claim 1, further comprising a material delivery device is disposed at a side of the outer modular base, said the material delivery device having a bottom panel and an outer cover forming a guiding channel for a terminal material tape to extend therein.

3. The pressing device for thin-film circuits and terminals in accordance with claim 1, further comprising a leading in device for leading-in a thin-film circuit is located at an outer side of the outer modular base said the leading device having:

a base fastened to the bottom panel;

a pair of side plates fastened to surfaces at two sides of the base, and a guiding channel formed between the side plates; and a flat plate fastened to an outer side of the base, such that the circuit is lead-in via the guiding channel and extended to the upper pressing plane.

4. The pressing device for thin-film circuits and terminals in accordance with claim 1, further comprising a pressure tank having a piston shaft, wherein the pressing block is connected with the piston shaft, thereby enabling the pressing block to make intermittent up and down displacement; the cutting block is fastened to a sliding block that receives forces from rotations of an eccentric axis, thereby enabling the cutting block to make intermittent up-and-down displacement.

* * * * *